US008985270B2

(12) United States Patent
Daniszewski

(10) Patent No.: US 8,985,270 B2
(45) Date of Patent: Mar. 24, 2015

(54) CLEAN BURN MUFFLER PACKING WITH STITCHED FIBERGLASS ENVELOPE

(71) Applicant: Molded Acoustical Products of Easton, Inc., Easton, PA (US)

(72) Inventor: Jakub A. Daniszewski, Brodheadsville, PA (US)

(73) Assignee: Molded Acoustical Products of Easton, Inc., Easton, PA (US)

( * ) Notice: Subject to any disclaimer, the term of this patent is extended or adjusted under 35 U.S.C. 154(b) by 0 days.

(21) Appl. No.: 14/173,891

(22) Filed: Feb. 6, 2014

(65) Prior Publication Data

US 2014/0251720 A1 Sep. 11, 2014

Related U.S. Application Data

(60) Provisional application No. 61/776,384, filed on Mar. 11, 2013.

(51) Int. Cl.

| | |
|---|---|
| ***F01N 1/24*** | (2006.01) |
| ***E04B 1/84*** | (2006.01) |
| ***F01N 13/18*** | (2010.01) |

(52) U.S. Cl.

CPC ..... *F01N 1/24* (2013.01); *E04B 1/8409* (2013.01); *F01N 13/1888* (2013.01); *F01N 2310/02* (2013.01); *F01N 2310/14* (2013.01)

USPC ..... 181/256; 181/252

(58) Field of Classification Search

CPC ..... E04B 1/8409; F01N 1/24; F01N 13/1888; F01N 2310/02; F01N 2310/14

USPC ..... 181/252, 256, 258

See application file for complete search history.

(56) References Cited

U.S. PATENT DOCUMENTS

| | | | |
|---|---|---|---|
| 1,382,394 | A | 6/1921 | Spurgin |
| 1,554,534 | A | 9/1925 | Straussler |
| 2,185,584 | A | 1/1940 | Boyce |
| 2,514,170 | A | 7/1950 | Walter et al. |
| 4,167,986 | A | 9/1979 | Conway |
| 4,324,314 | A | 4/1982 | Beach et al. |
| 4,361,423 | A | 11/1982 | Nitz |

(Continued)

FOREIGN PATENT DOCUMENTS

EP 0909845 A1 4/1999

OTHER PUBLICATIONS

International Search Report and Written Opinion in PCT/US2014/021730, dated Jun. 27, 2014.

*Primary Examiner* — Jeremy Luks

(74) *Attorney, Agent, or Firm* — Duane Morris LLP

(57) ABSTRACT

A muffler for a motor vehicle has a muffler housing with a packing void into which an envelope containing a loose fill material is installed during assembly. The envelope contains elongated strands of continuous strand fiberglass, woven as a fiberglass mesh fabric, and having a thin organic polymer coating to reduce sliding and/or being formed with a Leno or gauze weave structure. The envelope is joined at one or more stitched seams, preferably with cotton thread, to enclose a volume. The volume is packed with uncoated continuous strand fiberglass roving, filling the volume to complement the packing void. The cotton thread and the thin polymer coating are consumable by hot gas in the exhaust path, but produce minimal smoke and odor due to their compositions and the small proportion of the packing volume and surface area that the consumable portions occupy.

13 Claims, 5 Drawing Sheets

(56) References Cited

U.S. PATENT DOCUMENTS

| | | | |
|---|---|---|---|
| 4,580,656 | A | 4/1986 | Fukuda |
| 4,589,517 | A | 5/1986 | Fukuda |
| 4,673,058 | A | 6/1987 | Roberts et al. |
| 4,700,806 | A | 10/1987 | Harwood |
| 4,759,423 | A | 7/1988 | Harwood et al. |
| 4,844,722 | A | 7/1989 | Ebell |
| 4,846,302 | A | 7/1989 | Hetherington |
| 4,860,853 | A | 8/1989 | Moring, III |
| 4,947,957 | A | 8/1990 | Cullen et al. |
| 5,036,585 | A | 8/1991 | Schweinfurth |
| 5,428,194 | A | 6/1995 | Emrick et al. |
| 5,563,385 | A | 10/1996 | Harwood |
| 5,824,413 | A | 10/1998 | Schell |
| 6,068,082 | A | 5/2000 | D'Amico |
| 6,412,596 | B1 | 7/2002 | Brandt et al. |
| 6,942,628 | B1 | 9/2005 | Watson |
| 2005/0214519 | A1 | 9/2005 | Clements |
| 2010/0204388 | A1 | 8/2010 | Marsh et al. |

Plain Weave

Leno

Smoke Factor

200%
180%
160%
140%
120%
100%
80%
60%
40%
20%
A – 1 mil PP Bag
B – Standard
C – Clean Burn
50%
100%
25%
196%
100%
73%
0%
100%
25%
0%
100%
40%
100%
17%
A
B
C
Resin Smoke Index
Resin Weight
Thread Smoke Index
Thread Weight
Total Smoke Output

CLEAN BURN MUFFLER PACKING WITH STITCHED FIBERGLASS ENVELOPE

CROSS REFERENCE TO RELATED APPLICATION

This application claims the priority of U.S. provisional application 61/776,384, filed Mar. 11, 2013.

FIELD OF THE INVENTION

This disclosure relates to the field of mufflers for internal combustion engines based on loose packing fill that is confined at least substantially within an envelope of sheet material during assembly of the muffler. The envelope assumes a shape when packed with fill, and is placed as a unit in a void of substantially complementary shape in the muffler housing during assembly. An improved envelope for packing fill is constituted to minimize combustible materials that would emit smoke and odor when subjected to hot engine exhaust during muffler break-in, but has characteristics that maintain the integrity of the envelope until confined in the assembled muffler.

BACKGROUND

Mufflers, resonators and the like are provided along the exhaust lines of internal combustion engines to reduce noise emitted from combustion in the engine cylinders. A muffler typically defines an elongated path for exhaust gas that passes through or is bordered by a volume of packing material that attenuates sound vibrations. A simple example is a cylinder containing packing material traversed by a longitudinal tube for gas passage, with perforations in the tube exposing the gas path to the packing disposed around the tube. In other configurations, the path might define a circuitous route, and encounter baffles or screens. Attention is paid when structuring a muffler and its packing material to achieve an appealing or distinctive engine sound.

The packing fill in and around the exhaust gas path comprises resilient forms, typically thin fibers, that are resiliently displaceable with gas pressure variations at audible frequencies, thereby damping the amplitude of sounds emitted through the exhaust system. The fill needs to be confined in the muffler in one way or another so as not to become entrained in the exhaust flow and ejected. The fill is preferably not subject to chemical corrosion or combustion when subjected to the exhaust gas.

One way to confine muffler packing material and to retain a shape for the packing is to include an adherent binder so that packing fill fibers or other bodies adhere to one another where they come into contact. Such binders are typically oxidized, combusted and otherwise broken down in hot gas the environment of the exhaust. Furthermore, binders that hold the packing in a fixed shape during muffler assembly, and are intended to burn away in the hot exhaust, tend to smoke and smell during a muffler break-in period.

To endure with adequate longevity along the exhaust path, the fill material needs to be durable and chemically unreactive. To attenuate noise, the fill needs to be resilient and arranged as a porous mass in which acoustic waves can propagate, while filling out one or more shaped voids within the muffler. An apt material for muffler fill is fiberglass. Provisions are advantageous to conform and confine the fiberglass to the shape of the void in the muffler, at least during assembly of the muffler parts. Assembly typically involves welding or swaging of muffler housing parts at seams. Loose or stray packing fibers that become lodged between the housing parts at seams can interfere with obtaining a leak-proof continuous seam.

Fiberglass or other unreactive fiber fill materials can be coated with an adherent binder and compressed in a mold, such that the binder attaches fibers together where they come into contact, holding the mass of fibers in a shape. The molded shape preferably eliminates stray fibers by fixing the relative positions of the fibers temporarily during muffler assembly. After assembly, packing is confined by the muffler structures forming the void for the packing. The binder burns away in the hot engine exhaust during an initial break-in phase of the muffler.

U.S. Pat. No. 6,068,082, dated May 2, 2000 (hereby incorporated by reference in its entirety), discloses a technique wherein continuous strand fiberglass roving is used as a muffler fill material. The continuous strand fiberglass roving is packed into an envelope of plastic mesh, heat sealed at envelope seams. The packed fill expands the envelope to complement the shape of the void in the muffler. The packed envelope is placed in the muffler packing void during muffler assembly. The open plastic mesh of the envelope confines the fiberglass roving and does not interfere substantially with movement of exhaust gas. Thus the envelope has little or no effect on the sound of the muffler. The sound of the muffler remains the same through the break-in period when the plastic mesh envelope is consumed and burns away. However, the plastic mesh produces smoke and odor as it burns away. The volume of plastic contained in a plastic mesh envelope confining uncoated fiberglass roving fill, and the surface area of the plastic, are smaller than is the case where adherent coating is applied to all the surfaces of strands of packing fill, which limits the amount of smoke and odor emitted during break-in. But it would be advantageous if the smoke and odor could be further reduced.

It should be appreciated in this disclosure that the concept of continuous strand fiberglass roving is meant to encompass variations in which the strands are single strands or multi-fiber yarns. Further, the strands or yarns need not extend continuously between extreme ends of a given run of structure (such as a filled muffler) to be deemed continuous. A continuous strand or yarn can comprise two or more lengths that are lengthwise adjacent, adjacent around a gap, or perhaps overlap one another for a distance along their lengths. This construction is generally consistent with industry usage where "continuous strand" denotes elongated fibers, often used in alignment to form yarns or fabrics, or handled in alignment with one another during filling as with continuous strand roving. Continuous strand roving is distinct from "chop strand," the latter referring to fibers that are relatively short and typically are handled or used in random fiber alignment. Either continuous strand or chop strand can form a packing mass, a batt or a compressed non-woven mat that may be regarded as a fabric. However continuous strand but not chop strand is capable of formation into a weave or knit wherein the fabric has regularly oriented fibers spaced by gaps so as to provide a mesh, and capable of being stuffed or packed to fill out a confined space without the need to adhere the fibers to one another.

Continuous strand fiberglass roving tends to distribute itself fairly evenly in a confined space. The density of the packing can be controlled by the length of the roving that is run into the confined space or packing envelope using nozzle-like injectors that blow in a plurality of strands from spools. The fiberglass is non-reactive and produces neither smoke nor odor during its break-in period. Nor is there a change in muffler sound.

The housing of an assembled muffler forms a substantially closed void that might confine loose fiberglass roving if the roving could be introduced into the void. But it may be difficult to inject and/or introduce continuous strand fiberglass roving inside a pre-assembled muffler, although "direct fill" into an assembled muffler housing may be possible if the void for the packing is accessible and the void for the packing has a regular geometric shape. For more complicated shapes such as automobile mufflers with horizontal dividing panels, the voids that need to be filled with packing are relatively inaccessible.

One might attempt to assemble a muffler housing around a loose mass of uncompressed fiberglass roving, so as to compress the mass of roving as part of the process of bringing muffler housing parts together and thereby pack and fill the void that the parts close around. That process is difficult to accomplish, at least without stray packing fibers tending to interfere with making a continuous seam along the housing parts.

For these reasons, a confining envelope of lightweight wide-gap mesh is useful. However smoke and/or odor are associated with consumption of the mesh if it is made of plastic, even if the mesh fiber portions are thin and the gaps are wide. There is a limit to how wide the openings of a plastic mesh can be made, and how thin the mesh strands can be while being heat-sealable effectively, and otherwise made strong enough to form a fixed shape that confines compressed fiberglass packing and does not tear open at seams or permit packing strands to protrude from mesh gaps. It would be advantageous to provide improvements that provide a robust envelope and employ even less consumable material.

SUMMARY

Mufflers embodiments are disclosed herein for internal combustion engines, based on loose fill fiberglass enclosed in an envelope, preferably continuous strand fiberglass roving. Provisions are disclosed to facilitate placement and retention of a mass of loose fiberglass fill in a muffler housing void having a defined shape. These provisions can include enclosing the fiberglass fill in an envelope of sheet material. The sheet material can comprise a fabric of fiberglass fibers. Emission of smoke and odor is reduced or eliminated during a break-in phase when the muffler packing is subjected to hot exhaust gas that typically burns away combustible material. This is accomplished by using fiberglass rather than plastic as the material of the fabric envelope; by choice of a fabric structure that requires little or no adherent coating on the fibers; by selection of clean burning coating materials for fiberglass strands forming the fabric envelope if coating is used, and keeping the coating thin when practicable; and by selection of materials for stitching together the seams of sheets or panels that define the envelope.

More particularly, continuous strand fiberglass roving as fill is enclosed in an envelope of sheet material that likewise is comprised substantially of fiberglass. The mesh of the fiberglass of the envelope advantageously is no more dense than the fiber density of the compressed packing in the fill, thus making the envelope invisible from an acoustic standpoint.

Uncoated fiberglass strands or yarns slide over one another easily, which can degrade a mesh made of such strands or yarns or lead to fraying of edges. According to one aspect, an adherent coating is applied lightly to the strands of fiberglass forming the envelope (not to the packing fill strands to be confined by the envelope) for maintaining mesh strength and good handling characteristics. Although a non-woven fabric envelope of fiberglass can be employed using coated fiberglass fibers forming a batt, advantageously the fiberglass fabric envelope is woven, and certain weave types can be used to maximize strength while minimizing the need for adherent fiber coating. Certain clean burning resin compositions are disclosed (low smoke and low odor) for the coatings on fiberglass strands or yarns used for the material forming the mesh sheet or fabric layer of the envelope enclosing loose fiberglass fill. In one embodiment the enveloping fabric sheet material comprises fiberglass coated with a plastic resin, particularly acrylic or polyester resin, in a weight percent range that is low compared to the fiber weight.

In a further aspect, the fiberglass fiber sheet comprises a fiberglass fabric woven to define a porous mesh. The fabric can be a relatively open plain mesh weave, or in another embodiment, a Leno weave provides greater fabric strength per weight of fiber and reduced need for coating. In another aspect, sections of the fiberglass fabric or mesh are stitched together at seams or hems using a clean burning (low smoke) thread or yarn such as cotton. Inasmuch as the seams of the envelope are closed by stitching instead of heat sealing, any adherent coating on the fiberglass fabric or mesh fibers for preventing slippage of the fibers can be very thin. Minimal smoke or odor arise from consumption of the stitching thread or yarn during break-in.

An object of this disclosure is to improve on the concept of enclosing compressed continuous strand fiberglass roving in an envelope to be installed in a muffler housing. According to respective aspects, material selections are optimized for the roving, for the envelope, and for the materials and techniques by which the envelope is closed. The envelope can be at least as pervious to exhaust gas flow as the compressed roving forming the volume of the muffler packing, and can be more pervious. The fiberglass fabric of the envelope produces minimal smoke due to consumption of the fiber coating on the envelope due to exposure to hot exhaust gases, but the envelope represents a very small proportion of the muffler packing assembly.

It is preferred to produce the fiberglass fabric envelope with an organic coating that fixes the relative positions of fiberglass strands (or yarns of plural strands) forming the envelope. It is also preferred to use a flexible thread such as cotton for stitching. The coating and the thread for stitching do produce some smoke, but in reasonably acceptable levels compared to their effects on the character of the envelope fabric and the ease with which seams and hems that can be stitched. There is no noticeable change in the muffler sound over the break-in period.

BRIEF DESCRIPTION OF THE DRAWINGS

These and other objects and aspects will be appreciated by the following discussion of preferred embodiments and examples, with reference to the accompanying drawings, and wherein.

DETAILED DESCRIPTION OF EXEMPLARY EMBODIMENTS

Figure 1:
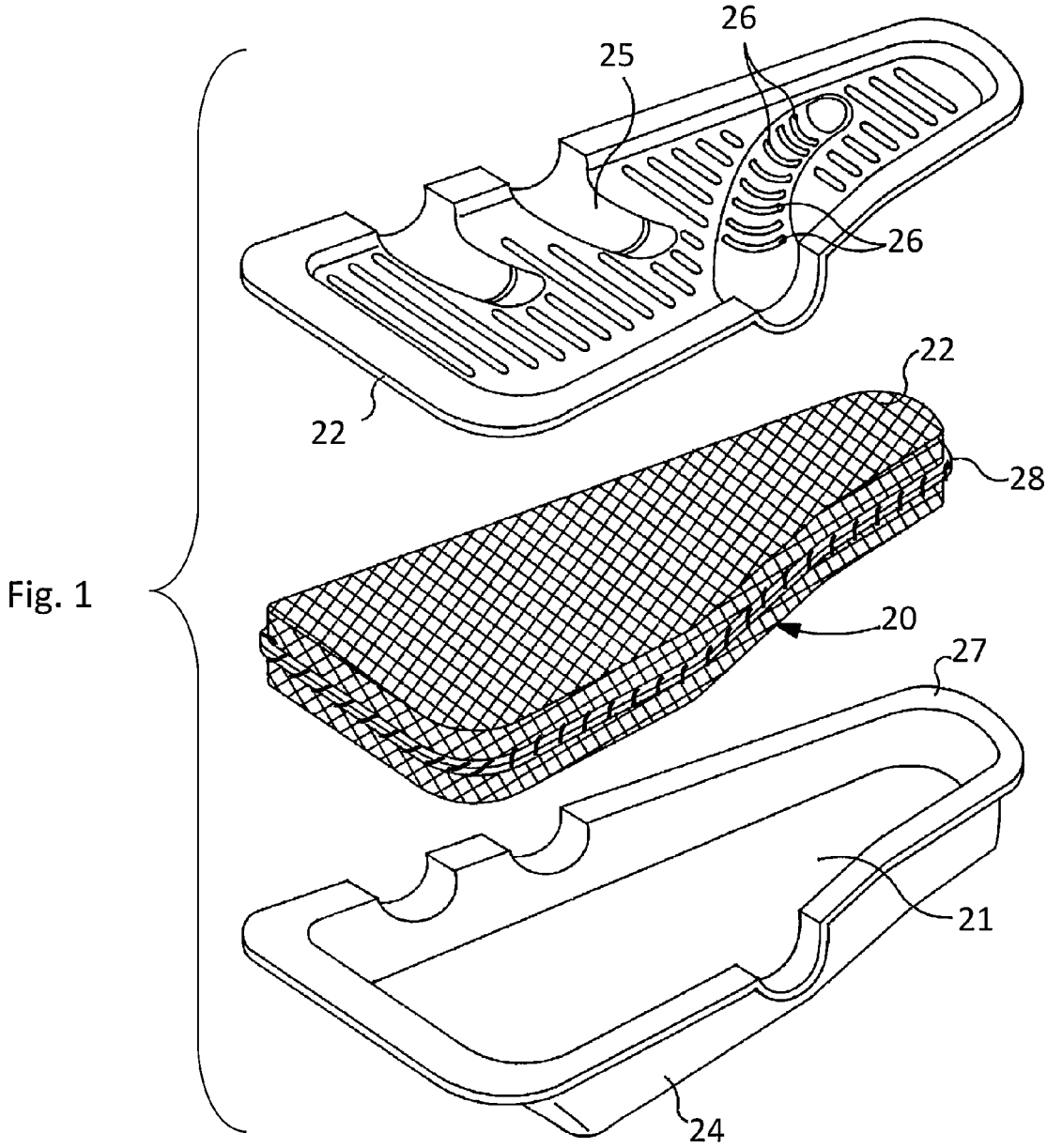
FIG. 1 is a partial assembly view of a muffler containing a muffler pack as disclosed herein.

A low smoke packing enclosure for a muffler or resonator as shown in FIG. 1 comprises an open mesh or thinly structured fiberglass fabric forming an envelope around a fibrous packing material such as continuous strand fiberglass. The envelope, and the muffler packing in the envelope, and the structure that closes the envelope to confine the packing, are all composed and constructed to emit a minimum amount of smoke and odor when the muffler or resonator is placed into use. In particular, the assembled packing and envelope contain a minimum of consumable material.

It is known for packing enclosures to use thermoplastic polymers of an organic nature, and the polymer is consumed during a break-in period by the heat of the exhaust of the engine, producing smoke and odor. As disclosed herein, the continuous strand nature of the fiberglass roving packing material fills and shapes the envelope and does not require a binder to immobilize the packing strands, as may be the case with binder-coated chopped fiber fill that is molded to shape. The continuous strands obviate the need for a consumable binder in the fill.

In certain examples disclosed herein, the envelope likewise is formed of continuous strand fiberglass. This reduces the need for consumable materials associated with the envelope structure. The envelope has an open fibrous structure that is no more obstructive to gas through-flow than the fiberglass packing. In certain embodiments, the fiberglass of the envelope is woven in a manner that produces a structurally stable fabric due to interaction of the warp and weft. In some embodiments, the envelope comprises an open mesh plain weave of continuous strand fiberglass with a minimal binder provided on the fabric fibers to enhance adherence at the crossing points of the warp and weft, or at least to reduce sliding that could deform the regular mesh of the weave and permit openings to form where the packing material may herniate. This minimal binder makes the envelope fabric easier to handle and to stitch closed, which is accomplished using a low smoke natural cotton thread. The fabric envelope need only hold the general shape of the void in the muffler housing until the housing is assembled with the envelope-confined packing therein. Once assembled, the housing confines the packing even if the envelope should be structured to fail.

Figure 6:
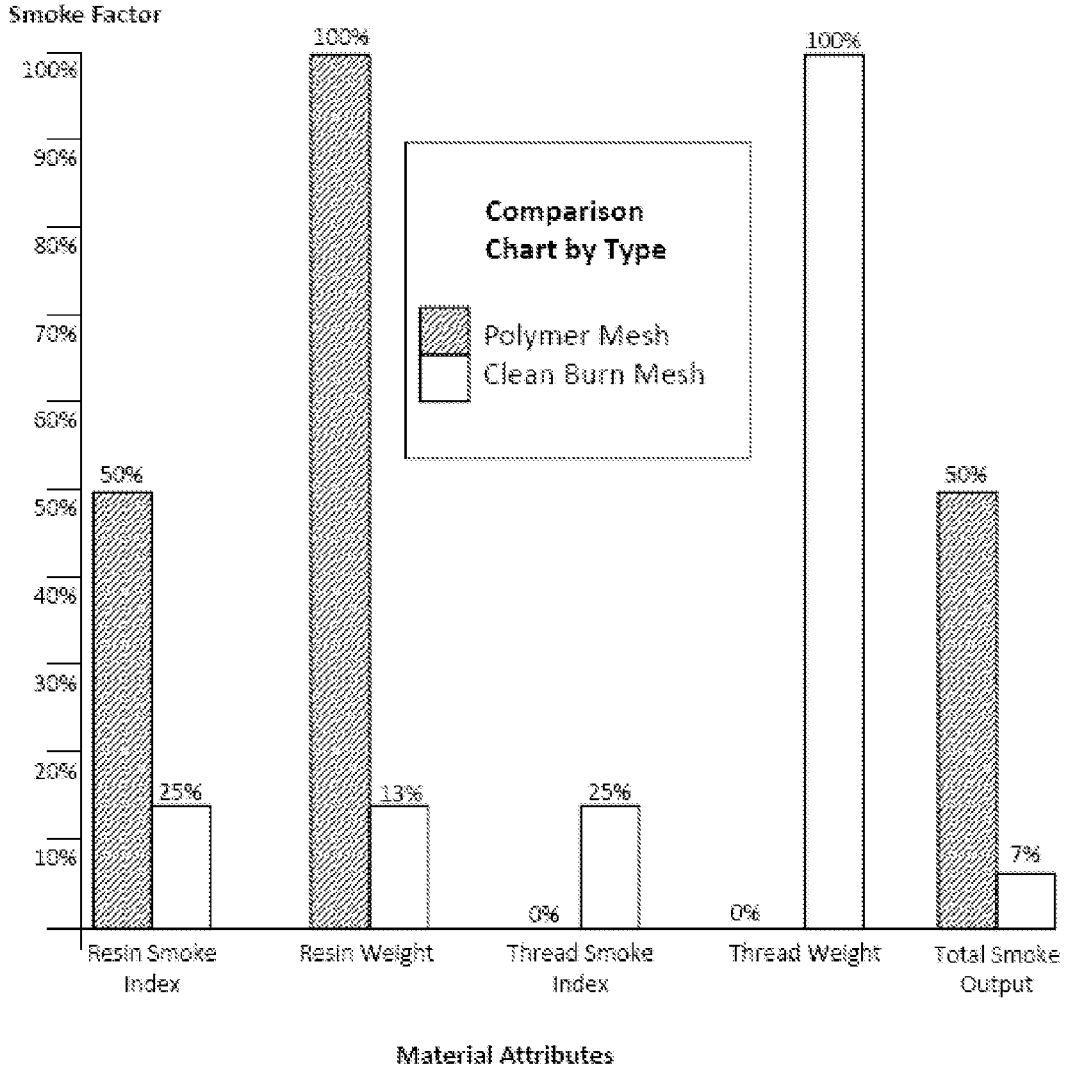

Accordingly, an aspect of this invention is to provide as minimal an envelope structure as needed to hold the packing, using as little consumable material as possible, while nevertheless enabling the envelope to be produced, cut to the necessary pattern, at least partly closed and stuffed or filled with packing, and used to confine the packing during assembly of the muffler housing. With reference to FIG. 6, these techniques can reduce the amount of smoke and odor emitted during break-in to one seventh or less of the amount that might be expected with techniques that confine muffler fill in a plastic mesh envelope.

As shown in FIG. 1, a muffler packing assembly 20 is provided for placement in a void 21 defined between two or more muffler housing elements 22, 24 forming a volume along an exhaust path or adjacent to the exhaust path. In this example, the housing elements 22, 24 form inlet and outlet openings 25 and expose the packing assembly 20 to the exhaust path through vent openings 26. Other arrangements are possible for mufflers (which should be construed to include resonators and other sound and vibration damping devices).

The packing assembly is shaped to complement the void 21 sufficiently to prevent the packing assembly or its fibrous contents from coming between the housing elements 22, 24 at a perimeter flange 27 where the housing elements need to be in direct contact for welding, swaging or similar steps that close off the volume containing the muffler packing. In the embodiment shown, the envelope is defined by pattern parts that are stitched closed around a seam 28. The filled envelope need not be precisely complementary with the void. In different embodiments, the filled envelope can be oversized at rest so that the envelope is compressed during assembly of the housing parts, or the envelope can be undersized but resiliently packed to the extent that when the stitching closing the seam 28 burns away, the packing expands to fill the void.

Figure 2:
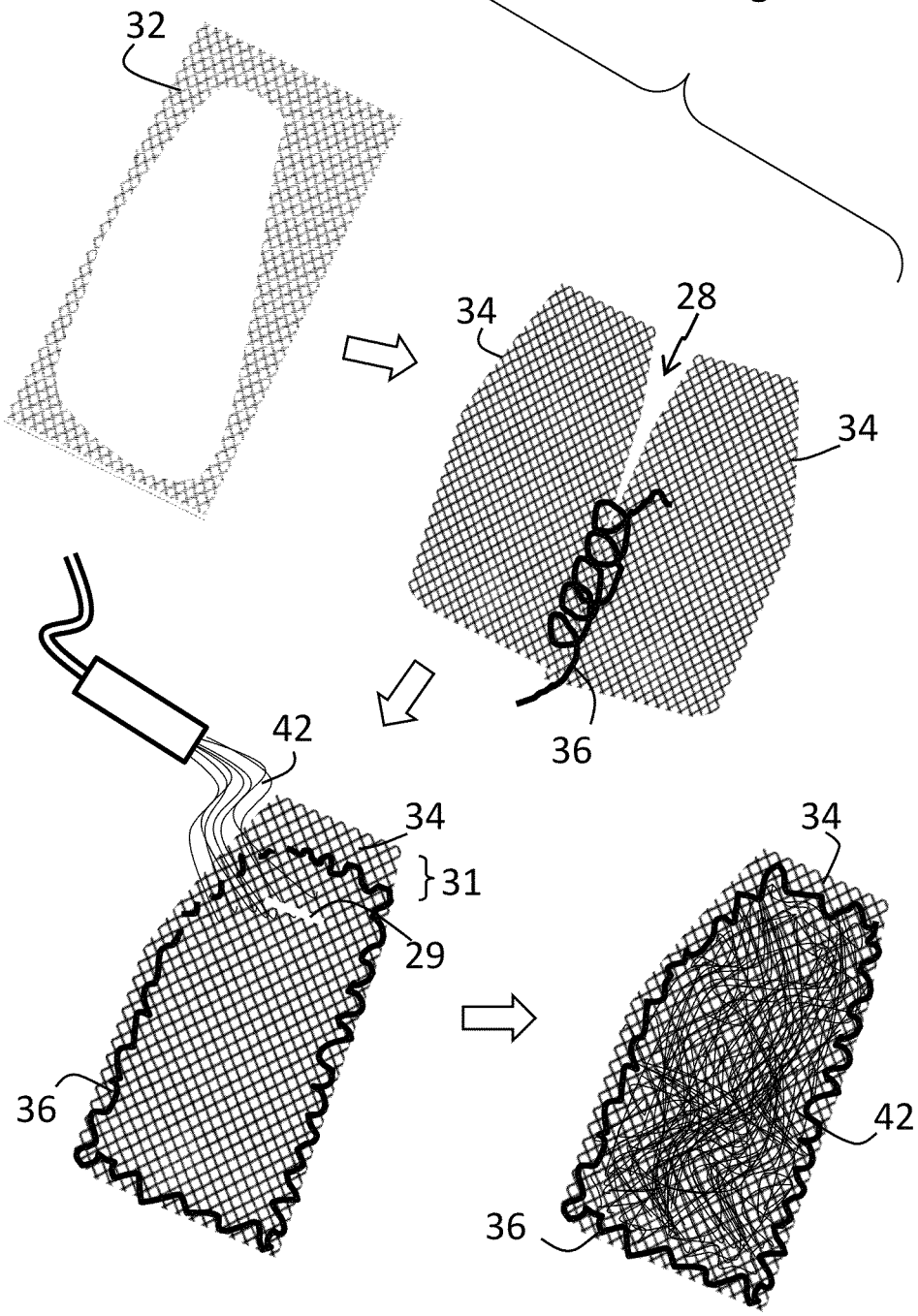
FIG. 2 is a flow diagram showing the steps in production of the muffler pack for the assembly of FIG. 1.

The envelope of the packing assembly comprises fabric from one or more pieces of sheet material 32, shown in FIG. 2, which in successive steps are stitched to provide an enclosure, filled with packing such as fiberglass roving through one or more openings, and more or less completely closed to contain the packing forming a predetermined shape. In this state, the envelope-enclosed packing provides an assembly component that is conveniently placed and enclosed when assembling the muffler housing parts 22, 24.

The envelope of sheet material 32 comprises elongated strands forming a fabric, two pieces 34 being cut out in the necessary shape in FIG. 2, joined at least at one seam 28 at which edges of the sheet material are joined to enclose a volume. Preferably, the volume is closed by stitching a thread 36 completely around a perimeter, and a small slit 29 is provided to insert the nozzle for emitting the loose fill material 42 into the fabric defined envelope. The fill material expands the envelope and fills the volume so as to complement the void. In this embodiment, the sheet material 34 and the fill material 42 both comprise continuous strand fiberglass. The fill material consists essentially of fiberglass roving, namely long strands of fiberglass, without an adherent binder coating. A slit 29 is advantageous as a close-fitting opening through which the nozzle can be inserted to emit fill material 42 into an envelope that is fully stitched around the perimeter. The slit 29 tends to be drawn closed after removal of the nozzle due to inflation of the envelope from the filling. Other specific filling and closing techniques are possible. For example a gap in the thread seam can be left around the perimeter to admit the nozzle, the gap being stitched or basted closed after filling, shown as a broken line section of thread 36 in FIG. 2, or a gap the is left unstitched can be closed by folding over a flap, for example a flap 31 as shown.

The fabric of the envelope also comprises long strands of fiberglass, but in the case of the envelope, the strands are formed as a fiberglass mesh or fabric, arranged in a manner that remains as a continuous sheet 34, so that the envelope 20 retains the fiberglass strand packing 42, long enough to enable assembly of the muffler housing parts 22, 24, with the filled packing envelope therein. Once assembled, the structure of the sheet material 34 and the envelope 20 are unimportant because the muffler housing parts 22, 24 confine the packing material 42. The stitching can be arranged to burn away. It is an aspect of the invention that by minimizing the use of consumable materials in the compositions of the packing 42, the sheet material 34 and also the stitching used to close seam 28, the envelope 20 facilitates handling of the packing and assembly of the muffler housing around the envelope, while minimizing the emission of smoke and odor when the muffler goes into service and hot exhaust gases burn away any combustible materials that remain.

The fabric of sheet material 34 can be a matt of short chopped fiberglass strands if a binder is provided on the strands such that the strands adhere to one another where the strands come into contact. However, the use of a binder can be minimized if the sheet material 34 is structured to remain in the shape of a sheet during assembly and filling of the envelope 20. For this purpose, the sheet material preferably is formed using long fiberglass strands, woven so as to hold the shape of a sheet. In embodiments shown in FIGS. 3 and 4, the exemplary materials for sheet material 34 are fiberglass warp and weft (fill) strands of one or more fibers, respectively formed as a plain weave and a Leno weave.

Weaving the fibers contributes to the stability of the fabric structure so that the enclosure formed by the envelope 20 remains intact during filling and handling. However, there are some considerations. The fabric structure should be sufficiently loose (characterized by gaps that are through openings) to permit gases to flow through the envelope freely. The density of the fibers in the fabric can be made no more dense than the density of the packing material, such as continuous strand roving 42 packed to a predetermined density. The fabric fiber density can be low, such that the fabric is generally an openwork mesh. However a very loose fabric structure lacks the capacity to prevent the strands of the warp and weft from sliding over one another, which can permit holes in an openwork mesh to become enlarged, adversely affecting the capacity of the envelope fabric to prevent protrusion of the packing material beyond the shape defined by the envelope.

Figure 3:
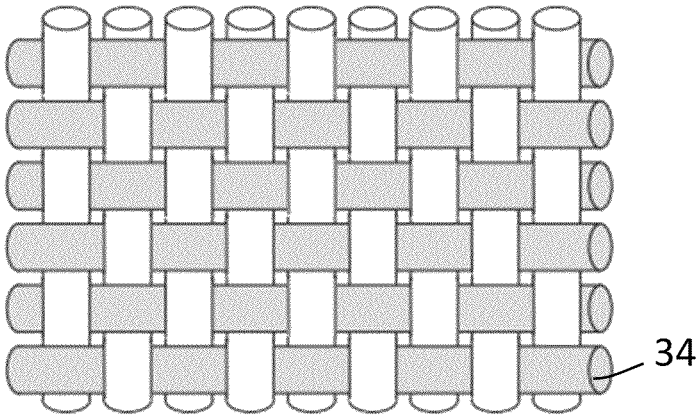
FIG. 3 is an elevation view showing a plain weave structure for the envelope of the muffler pack of FIG. 1.

The plain fabric weave shown in FIG. 3 is a common weave style. Fiberglass glass warp yarns and fiberglass filling or weft yarns are interlaced in a repeating one over and one under pattern. The parallel yarns are relatively tight against one another, resulting in good fabric stability. Although this weave is generally stable, it is not as pliable as other weave styles that may be used.

Figure 4:
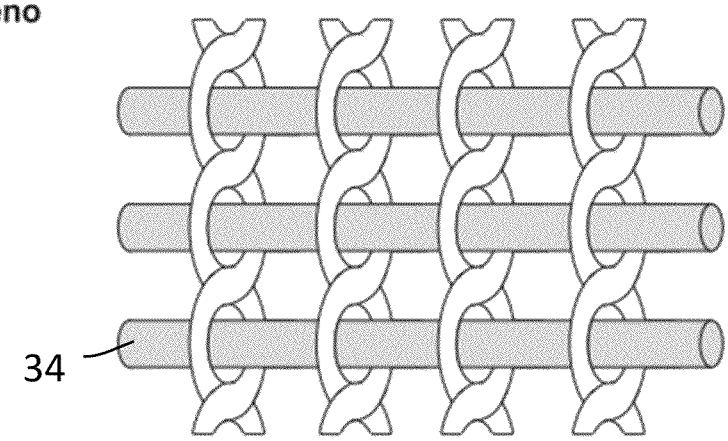
FIG. 4 is an elevation view showing a Leno weave structure for the envelope of the muffler pack of FIG. 1.

In FIG. 4, a Leno style of weave has some capacity to deter sliding between strands of the warp and weft. As in the plain weave of FIG. 3, the warp and weft strands of the Leno weave alternatively pass over and under one another in alternating manner. In the Leno weave, however, the weft strands extending vertically each also passes alternatively on the left or right of an adjacent weft strand, thereby capturing those two weft strands relative to one another while engaging with the intervening warp strands, particularly when tension is applied to the weft. The Leno weave can use a comparatively lighter weight fiber or yarn for the weft strands and heavier weight for the warp strands, and achieves strength comparable to a plain weave, improved fabric strand stability, and less obstruction to gas through-flow. The Leno weave has a low yarn count as well as an open weave effect. Although the weave is open (characterized by relatively large gaps between parallel strands as compared to a plain weave) and freely permits passage of air through the fabric, the Leno weave fabric is durable with good dimensional stability. Unlike most open weave fabrics, the Leno weave maintains yarn uniformity and there is little yarn slippage or distortion, which enables fabric binder to be reduced or eliminated. Leno thus is an advantageous weave for a clean burning muffler packing envelope as disclosed herein.

Furthermore, it has been determined according to the invention, that one can employ a consumable coating on the strands forming the fabric, wherein the coating limits sliding of strands due to adherence at points where strands engage against one another in the weave, with good results and minimal production of smoke and odor, provided that the coating is applied thinly and only to the fabric strands, not to the packing strands.

In one embodiment, the envelope 20 comprises fiberglass mesh strands that are thinly coated with an adherent low smoke polymer coating so as to improve the stability of the fabric, which retains a regular mesh structure during production, i.e., formation into a bag or envelope by closing a seam at which mesh edges overlap, filling with continuous strand fiberglass roving through a slit in the fabric. For use as a low smoke polymer coating on the fabric fibers (only), acrylics are advantageously slow-burning and burn with little smoke or toxicity. During combustion, acrylics form carbon dioxide, water, carbon monoxide and low-molecular-weight compounds, most of which produce white smoke if any noticeable smoke.

Coating materials that are adherent but are more apt to produce smoke include SBR (Styrene Butadiene Rubber), Polyethylene and Polypropylene. These coating materials release volatile hydrocarbons evaporating from the polymer and carbonaceous particles. The carbon particles appear as black smoke, which normally is less desirable than acrylic, although capable of stabilizing a woven fabric and applicable if applied quite thinly or if smoke and odor during break-in are not major problems.

An advantageous thread 36 used to close the seam is a light cotton thread. Cotton emits white smoke during combustion, as the cellulose structure of the natural fiber breaks down into water droplets and unburned fuel particles. Most of the carbon particles are left behind in the form of ash, rather than being released as partially combusted carbon or soot particles, i.e., black smoke.

During combustion of most organic materials that are useful for coatings or thread in a muffler/resonator, namely during a break-in time after installation, the coated mesh releases some smoke and/or odor as a result of oxidation of the coating matter and stitching thread burns away. However, the smoke and odor of an acrylic coating and cotton stitching thread are less than characterized by prior art polymer meshes comprising SBR, polyethylene or polypropylene, heat sealed instead of stitched closed, or if stitched having a smoke-emitting hydrocarbon thread composition such as polyester. Those compositions can provide a stable fabric closed at seams, but emit undesirable odor and black smoke when burned off.

Figure 5:
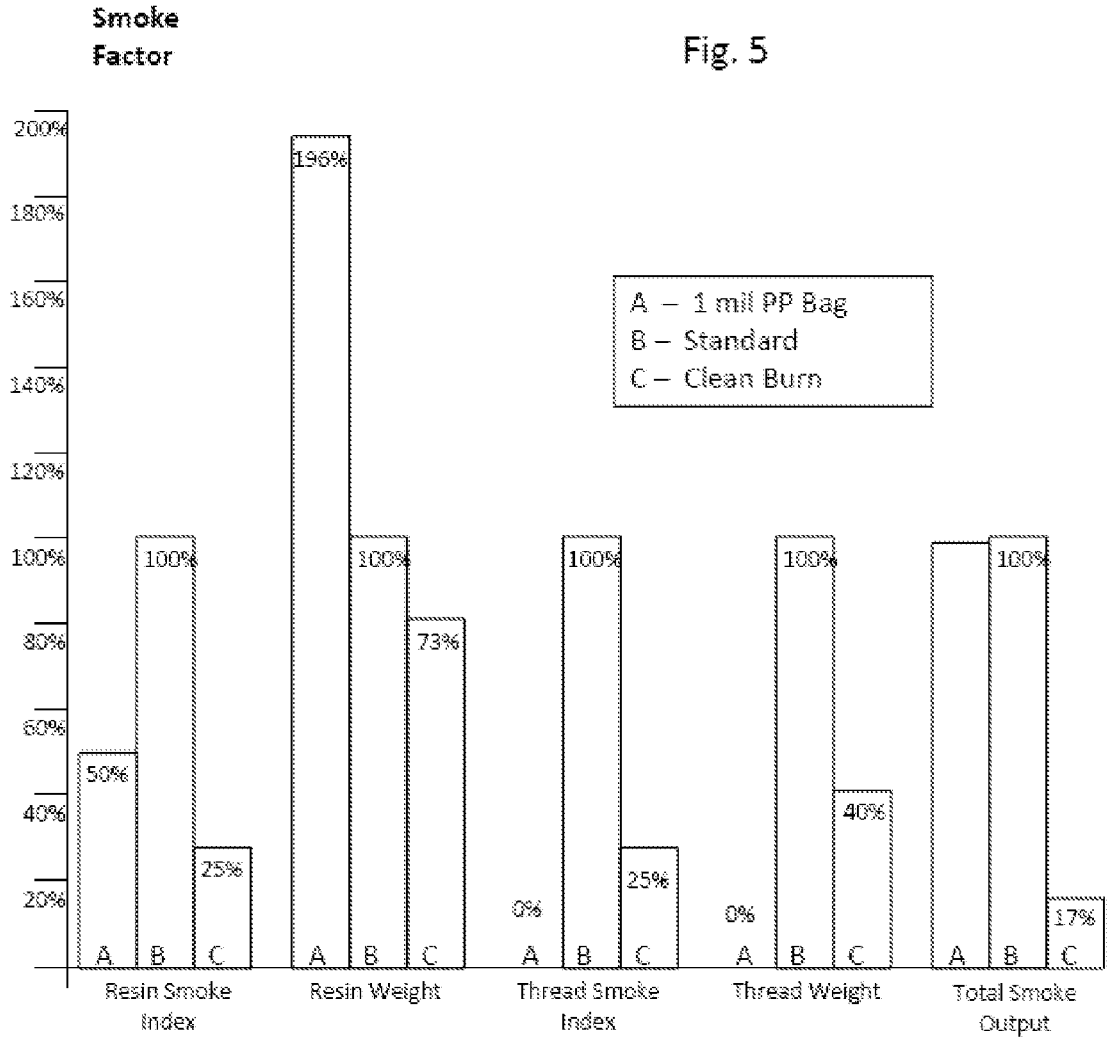
FIG. 5 is bar a diagram comparing the smoke emitted using alternative envelope structures and materials as discussed herein; and, FIG. 6 is a graphic comparison of the burn-in emissions according to the present invention versus a heat sealable thermoplastic mesh envelope as in U.S. Pat. No. 6,068,082.

FIG. 5 is a bar chart comparison of the typical amounts of smoke produced by a polypropylene plastic bag envelope versus a coating on a fiberglass fabric and separately showing the contribution of stitching thread, that can be expected when employing a thermoplastic sheet polymer bag envelope as the worst case for comparison (bar columns labeled "A"), versus the clean burning coated fiber envelope and packing of the invention (bar columns labeled "C"). A reference line is defined by equal-height reference bars (bar columns labeled "B"), which represent emissions of a fiberglass mesh coated with an SBR polymer, and using a polyester thread for stitching closed a perimeter seam.

FIG. 6 compares the extent of smoke emissions of a heat sealed polymer mesh envelope and a clean burn fiberglass fabric envelope as discussed herein, assuming that the clean burn fiberglass envelope is minimally coated with an acrylic resin that reduces the freedom of fibers to slide over one another where the fibers are in contact. It should be appreciated that using somewhat more resin is possible to improve fabric stability but to contribute more smoke, or somewhat less resin to reduce smoke at the expense of fabric stability.

One object of the present invention is to employ a different type of polymer coating on the fiberglass mesh, such that the envelope emits less smoke, and smoke of a less intrusive and potentially unhealthful character. In accordance with one embodiment, acrylic and/or polyester thermoplastic resins are used as coatings for the fiberglass that is formed into the sheet material envelope enclosing the packing material. These resins have properties of releasing low amounts of lightly colored smoke during combustion.

The organic resin can be present in an amount of about 5 to 20% by weight of the combined coating and coated fiber. A preferred range is about 10 to 16% by weight of resin to coated fiber. About 13% by weight is particularly preferred. These weight restrictions have been found to provide favorable low smoke characteristics while not compromising proper handling and processing of the mesh, such as the extent to which crossing mesh fibers adhere to one another and thereby retain the structure of the mesh during handing, filling and stitching closed. The loose fill material 42 comprises substantially uncoated continuous strand fiberglass roving.

Another object is to optimize materials used in affixing together panels of the envelope at seams, such as seams connecting the edges of two mesh panels forming a top and bottom of the envelope. The seam can be achieved by overlapping and stitching together (sewing) the two panels around a perimeter using thread. A preferred thread comprises cotton material, which has low smoke and odor characteristics. Alternative threads can comprise Nomex® or Kevlar® materials (commercially available from DuPont).

The quantity of thread in the stitching of the seam 28 is very much less than the quantity of other fibers present, considering volume, weight, surface areas, etc. The quantity of thread in the stitching can be further minimized by using a low ratio of stitch yarn length to seam length (i.e., a sparse stitch, a discontinuous stitch, basting or the like. In a preferred embodiment, the seam comprises a stitch formed in the fabric by a low-smoke thread at a ratio of thread length about two to ten times a length of perimeter stitched by the thread.

An advantageous thread material and structure comprises natural cotton with a linear mass density of Tex 27 to Tex 80 (a unit of linear mass density, i.e., 27 g/1000 m to 80 g/1000 m). A preferred linear density is Tex 40 linear mass density. The thread closes a seam in fabric having a mesh construction between about 5×2 and about 32×28 warp and fill yarns per inch. The stitch can be structured to include one of a lockstitch and chainstitch, at between about 5 and 25 stitches per inch.

The amount of thread used for stitching depends on the length of the perimeter being stitched along the edge of the muffler bag or enclosure, the stitch type and the stitching density per unit length. Depending on the extent and character of handling of the filled envelope after filling/closing and before installing, a greater stitch density may be preferable to survive rough handling, or a lesser stitch density may suffice. Stitch thread length can range from about two (2) to twenty (20) times the perimeter length encompassed by the stitch. Some typical ratios are a stitch thread length of 2.5, 5.5 and 20 times the perimeter distance. Exemplary desirable stitch types are ISO 301 (generally known as lockstitch), ISO 401 (chainstitch) and ISO 516 (safetystitch). A preferred range for stitch density is 5 to 25 stitches per inch (SPI). Three desirable stitch densities in that range are 7 SPI, 10 SPI and 17 SPI. Adopting the higher ratios and stitch densities improves the durability of the filled envelope to survive rough handling, but the added stitching thread contributes to the smoke produced during burn-in.

Another advantageous aspect concerns the particular construction of the fiberglass mesh. The mesh weave pattern can be plain or Leno weave, for example. The Leno weave (also known as gauze weave) produces an open fabric with limited freedom for yarn slippage or misplacement of threads. The mesh construction (i.e., the number of warp and fill yarns) ranges from about 5×2 per inch to about 32×28 per inch. The weight ranges from about 1.0 oz/yd$^2$ to 4.1 oz/yd$^2$. A preferred mesh construction range is about 12×6 per inch to 20×10 per inch, and a preferred weight range from about 1.1 oz/yd$^2$ to 1.8 oz/yd$^2$.

Three desirable mesh styles are 1659, 1671 and 1663, per ASTM D579/D579M. Style 1659 is a Leno weave, with a 20×10 yarn count per inch, warp yarn being ECG 150—1/0 and fill yarn being ECG 75—1/0 per ASTM D578, and a weight of 1.60 oz/yd$^2$. Style 1671 is a Leno weave, with a 18×9 yarn count per inch, warp yarn being ECG 150—1/0 and fill yarn being ECG 75—1/0 per ASTM D578, and a weight of 1.50 oz/yd$^2$. Style 1663 is a Leno weave, with a 16×8 yarn count per inch, warp yarn being ECG 150—1/0 and fill yarn being ECG 75—1/0 per ASTM D578, and a weight of 1.20 oz/yd$^2$.

A further object of the present invention is the use of an alternative type of loose packing material. The material is a Type E-CR Fiberglass Continuous Filament Roving, with a minimum softening temperature of about 916° C. (1681° F.). Rovings meeting these criteria are commercially available as Owens Corning Advantex®, PPG Innofiber® CR, and CPIC ECT.

The invention can be alternatively characterized as a muffler packing insert, or as a muffler containing a packing insert. And "muffler" is construed to include resonators and similar vibration damping devices. Thus, a muffler to be mounted along an exhaust path of an internal combustion engine includes a muffler housing 22, 24 assembled to define a packing void 21 that is exposed to the exhaust path, the packing void carrying packing formed with an envelope 20 containing a loose fill material 42, wherein the envelope 20 comprises a sheet material 32 including elongated strands of continuous strand fiberglass forming a fabric of woven fiberglass mesh, the envelope including at least one seam 28 at which edges of the sheet material are joined to enclose a volume. The loose fill material 42 within in the envelope comprises continuous strand fiberglass in elongated strands, the loose fill material fills the envelope so as to complement the volume of the void.

According to one embodiment, a thin coating is provided on the sheet material, but preferably not on the fill material. The coating on the fibers can include at least one of acrylic and polyester resin is provided on the strands forming the fabric in an amount of about 5 to 20% by weight of the strands and the coating in combination, wherein the coating limits sliding of strands that engage against one another in the weave. For this purpose, it is possible to use a combination of coated strands and uncoated strands to make up the fabric. One possibility is to use coated strands for one of the warp and weft of a fabric and uncoated strands for the other of the warp and weft. Another possibility is forego coating or further minimize the amount of coating used, but to employ a weave such as a Leno weave to improve the structural strength of the fabric without using a coating. Any coating or other material that is consumable by hot gas will be consumed during a break-in period of the muffler, but as described, the break-in period will involve minimal production of smoke and odor.

The thread or yarn used to stitch closed the envelope also can be expected to be consumed during break-in. The muffler has a packing at least partly closed by a seam at which the edges of the sheet material are joined to enclose the volume. The seam comprises a stitch formed in the fabric by a thread chosen from the group consisting of cotton, Nomex and Kevlar. A preferred ratio of thread length to seam length is about two to twenty times a length of thread to length of perimeter stitched by the thread. The thread can comprise cotton with a linear mass density of Tex 27 to Tex 80, the fabric has a mesh construction between about 5×2 and about 32×28 warp and fill yarns per inch, and the stitch comprising one of a lockstitch, chainstitch and safetystitch at between about 5 and 25 stitches per inch.

The invention is likewise characterized as a method of producing and deploying a muffler packing or muffler, especially wherein a final step is subjecting the muffler to hot exhaust gas and the invention serves to minimize the production of smoke and odor while also optimizing production with minimizing smoke and odor as one object balanced against interests in efficient production of a durable muffler or muffler packing.

The method for manufacturing a muffler includes providing elements of a muffler housing that when assembled define a packing void configured to be exposed to an exhaust path, forming a pattern in sheet material for an envelope, the sheet material including elongated strands of continuous strand fiberglass fabric in a woven fiberglass mesh, joining the sheet material along at least one seam at which edges of the sheet material are joined such that the sheet material is formed into the envelope and encloses a volume, packing the envelope with a loose fill material comprising continuous strand fiberglass roving, the loose fill material expanding the envelope such that the volume substantially complements the void, wherein the sheet material for the envelope comprises a coating on the strands forming the fabric, with at least one of acrylic and polyester resin on the strands in an amount of about 5 to 20% by weight of the strands and the coating in combination, wherein the coating limits sliding of strands that engage against one another in the weave. Preferably the continuous strand fiberglass roving is substantially uncoated. The packed envelope is placed into the void during assembly of the elements of the muffler housing. After a break-in period wherein hot exhaust gases consume any materials subject to oxidation or similar deterioration, the coating is consumed.

Joining the seam at the edges of the sheet material comprises stitching the fabric using a thread chosen from the group consisting of cotton, Nomex and Kevlar, at a ratio of thread length about two to twenty times a length of perimeter stitched by the thread. The thread comprises cotton with a linear mass density of Tex 27 to Tex 80, the fabric has a mesh construction between about 5×2 and about 32×28 warp and fill yarns per inch, and the stitch comprising one of a lockstitch, chainstitch and safetystitch at between about 5 and 25 stitches per inch.

The invention has been disclosed in connection with preferred embodiments and examples. It should be understood, however, that the invention is not limited to the embodiments disclosed as examples, and can be embodied in other particular forms consistent the scope of the invention in which exclusive right are claimed below.

What is claimed is:

1. A muffler packing for placement in a void defined along an exhaust path, comprising:

an envelope of sheet material including elongated strands forming a fabric, the envelope including at least one seam at which edges of the sheet material are joined to enclose a volume, the fabric of the envelope comprising a woven in a Leno weave;

a loose fill material within the envelope including elongated strands that expand the envelope and fill the volume so as to complement the void;

wherein the sheet material and the fill material both comprise continuous strand fiberglass;

and wherein the muffler packing further comprises a low smoke polymer coating including acrylic resin on the strands forming the fabric.

2. The muffler packing of claim 1, wherein the fabric of the envelope comprises a fiberglass mesh.

3. The muffler packing of claim 1, wherein the coating limits sliding of strands that engage against one another in the weave.

4. The muffler packing of claim 1, wherein the coating is present in an amount of about 5 to 20% by weight of the strands and the coating in combination.

5. The muffler packing of claim 1, wherein the loose fill material comprises substantially uncoated continuous strand fiberglass roving.

6. The muffler packing of claim 4, wherein the seam comprises a stitch formed in the fabric by a thread at a ratio of thread length about two to twenty times a length of perimeter stitched by the thread.

7. The muffler packing of claim 6, wherein the thread comprises cotton with a linear mass density of Tex 27 to Tex 80, the fabric has a mesh construction between about 5×2 and about 32×28 warp and fill yarns per inch, and the stitch comprises one of a lockstitch, chainstitch and safetystitch at between about 5 and 25 stitches per inch.

8. A muffler to be mounted along an exhaust path of an internal combustion engine, comprising:

a muffler housing assembled to define a packing void that is exposed to the exhaust path, the packing void carrying packing formed with an envelope containing a loose fill material;

wherein the envelope comprises a sheet material including elongated strands of continuous strand fiberglass forming a fabric of woven fiberglass mesh, the envelope including at least one seam at which edges of the sheet material are joined to enclose a volume;

wherein the loose fill material within the envelope comprises continuous strand fiberglass in elongated strands, the loose fill material expanding the envelope and filling the volume so as to complement the void;

wherein a low smoke polymer coating comprising an acrylic resin is provided on the strands forming the fabric in an amount of about 5 to 20% by weight of the strands and the coating in combination, wherein the coating limits sliding of strands that engage against one another in the weave;

whereby the coating is consumable by hot gas in the exhaust path with minimal production of smoke and odor.

9. The muffler of claim 8, wherein the seam at which the edges of the sheet material are joined to enclose the volume comprises a stitch formed in the fabric by a thread consisting of cotton at a ratio of thread length about two to twenty times a length of perimeter stitched by the thread.

10. The muffler of claim 9, wherein the thread comprises cotton with a linear mass density of Tex 27 to Tex 80, the fabric has a mesh construction between about 5×2 and about 32×28 warp and fill yarns per inch, and the stitch comprises one of a lockstitch, chainstitch and safetystitch at between about 5 and 25 stitches per inch.

11. The muffler of claim 9, wherein the thread comprises cotton with a linear mass density of Tex 27 to Tex 80, the fabric has a mesh construction between about 5×2 and about 32×28 warp and fill yarns per inch, and the stitch comprises one of a lockstitch, chainstitch and safetystitch at between about 5 and 25 stitches per inch.

12. A method for manufacturing a muffler, comprising:

providing elements of a muffler housing that when assembled define a packing void configured to be exposed to an exhaust path;

forming a pattern in sheet material for an envelope, the sheet material including elongated strands of continuous strand fiberglass fabric in a woven fiberglass mesh;

joining the sheet material along at least one seam at which edges of the sheet material are joined such that the sheet material is formed into the envelope and partly encloses a volume;

packing the envelope with a loose fill material comprising continuous strand fiberglass roving, the loose fill material expanding the envelope such that the volume substantially complements the void;

wherein the sheet material for the envelope comprises a low smoke polymer coating on the strands forming the fabric, with an acrylic resin on the strands in an amount of about 5 to 20% by weight of the strands and the coating in combination, wherein the coating limits sliding of strands that engage against one another in the weave;

wherein the continuous strand fiberglass roving is substantially uncoated;

placing the packed envelope into the void so as to confine the loose fill material in the void, and assembling the elements of the muffler housing over the void.

13. The method of claim 12, wherein joining the seam at the edges of the sheet material comprises stitching the fabric using a thread consisting of cotton at a ratio of thread length about two to twenty times a length of perimeter stitched by the thread.

* * * * *